US005881824A

United States Patent [19]

von Gynz-Rekowski et al.

[11] Patent Number: 5,881,824

[45] Date of Patent: Mar. 16, 1999

[54] BOTTOMHOLE ASSEMBLY ORIENTING SUB

[75] Inventors: Gunther von Gynz-Rekowski; William C. Herben, both of Houston, Tex.

[73] Assignee: Pegasus Drilling Technologies L.L.C., Houston, Tex.

[21] Appl. No.: 863,657

[22] Filed: May 27, 1997

[51] Int. Cl.[6] ..... E21B 7/08; E21B 17/00

[52] U.S. Cl. ..... 175/45; 166/243; 175/320

[58] Field of Search ..... 175/45, 61, 73, 175/74, 423; 166/117.5, 117.6, 243

[56] References Cited

U.S. PATENT DOCUMENTS 3,052,309 9/1962 Eastman ..... 175/45
3,765,494 10/1973 Kielman, Jr. ..... 175/45 X
4,130,162 12/1978 Nelson ..... 166/243
4,789,032 12/1988 Rehm et al. ..... 175/45

*Primary Examiner*—David J. Bagnell
*Attorney, Agent, or Firm*—Rosenblatt & Redano, P.C.

[57] ABSTRACT

A mechanism for arients and maintains a key in a sub for guiding directional measurement equipment of a directional drilling assembly with respect to the drillbit. The orienting sub has an outer sleeve which is supported on an inner shoulder in the orienting sub. An inner sleeve which holds the key has an outer wedged profile which follows the shape of the outer sleeve. The outer sleeve can be longitudinally, obliquely, or spirally segmented and has a thread on one end so that a jam nut can be installed to advance the inner sleeve with the key until a wedging action occurs between the inner and outer sleeves and the sub. At that point, the key is oriented without any bores through the wall of the sub. Provisions can be made in the assembly to provide a biasing force on the inner sleeve which holds the key to compensate for vibrational loads on the assembly.

22 Claims, 4 Drawing Sheets

BOTTOMHOLE ASSEMBLY ORIENTING SUB

FIELD OF THE INVENTION

The field of this invention relates to orienting subs that are used between the drillbit and the measurement equipment like the measurement-while-drilling tools or the surveying tools.

BACKGROUND OF THE INVENTION

In directional drilling, a drillstring extends into a substantially vertical wellbore and normally supports a fluid-operated motor and a drillbit at its lower end. The drillbit is supported for angular drilling by using an external bent sub to support the downhole motor or by using a downhole motor with a bent housing. A directional measurement tool is connected above the motor to allow determination and control of the drilling direction (azimuth and inclination). An orienting sub, also known as a "muleshoe sub," is connected to the directional measurement tool for orienting the position of the directional measurement tool in relationship to the motor. The orienting sub is generally a tubular construction, with a connection to the directional measurement tool at one end and a connection to the bent sub or the upper motor housing at the other end. The orienting sub has a sleeve mounted in the housing, with an internal key to receive the muleshoe for locating the directional measurement tool in relation to the motor. The directional measurement equipment, to which the muleshoe arrangement is connected, generally includes an axially extending slot which communicates at its lower end with a camming surface. Abutting engagement of the key with the camming surface rotates the directional measurement assembly to permit the slot therein to receive the key. When the slot and key are fully engaged, the measurement equipment is accurately oriented with respect to the motor or bend sub so that it may accurately plot or record the orientation at which the key, and therefore the motor or bend sub, are disposed relative to a predetermined datum.

Referring to FIG. 4, a prior art design is illustrated. The thread 10 supports the downhole motor and, ultimately, the drillbit as well as the bent sub. These components have been omitted for clarity. At the upper end 11, a thread 13 accepts the tubing string to the surface, which will include as a component thereof the measurement tool with measurement equipment. Alternatively, the measurement equipment can be inserted through the passage 15 into the upper end 11. The measurement equipment has a longitudinal groove which will ultimately engage the key 14. The alignment of sleeve 12 is obtained by a series of set screws 16, which extend through the sub 22 and engage the sleeve 12. Thus, the orientation of the key 14 is accomplished at the surface when the bottomhole assembly is put together. Seals 18 and 20 prevent the mud that circulates in passage 15 downhole to the motor and the bit from escaping to the outside of sub 22. The problem with this design and similar designs known in the prior art is that the seals 18 and 20 ultimately fail, which results in flow around set screws 16 and ultimately a release of the grip by the set screws 16 of sleeve 12. When this occurs, the key 14 can move as the sleeve 12 can rotate within sub 22. When this occurs, there is a loss of orientation because the key 14 is no longer in alignment with the bend, either in the downhole motor or in a separate bend connection, which occurs before the bit. The loss of orientation cannot be seen immediately at the rig floor; therefore, the wellbore could be drilled in the wrong direction. There is also a loss of fluid to the mud motor as fluid in passage 15 escapes to the annulus.

Another problem with this design and similar designs known in the prior art is that the set screws sometimes don't develop enough grip. The set screws can get loose, especially if the measurement or surveying equipment is pumped down and the slot is initially misaligned with the key. The torque developed to turn the slot and, therefore, the measurement equipment can rotate the sleeve, which results in a loss of orientation.

U.S. Pat. Nos. 3,765,494 and 3,052,309 illustrate the use of external set screws 36 and 7, respectively, to hold the key in position.

Other attempts have been made to secure the position of the orienting sleeve for the muleshoe on the surveying tool by using a series of grooves and splines. Typical of such a design is U.S. Pat. No. 4,789,032. However, such designs are expensive to manufacture and are sensitive to wear from the erosive effects of flowing fluid, which in time washes out the grooves and splines. Ultimately, this will cause a loosening of the fit and a movement of the key as a result. Furthermore, the joint as illustrated in the '032 patent uses a shoulder above and below the sleeve, which makes the assembly sensitive to correct alignment, especially if a tapered thread is used. As a result, this type of connection has not been in widespread use. Yet another technique of securing the key of a sleeve which will ultimately guide the muleshoe is illustrated in U.S. Pat. No. 4,130,162. There, the sleeve holding the key is threaded to the sub and a unique thread arrangement is used where one part of the sleeve having the thread is compressed with a longitudinally aligned bolt. This design has disadvantages in that the mud flow eventually has erosive effects on the thread and the nature of squeezing one portion of the thread against another limits the amount of torque that the sleeve can withstand before the key which engages the muleshoe can turn, causing a loss of orientation. Another disadvantage of this design is that the sleeve is prevented from rotating by the means of axial compression of the crest of the male and female threads against each other, which will result in plastic deformation of flanges from thread crests due to compressing action. This design will be difficult to torque sufficiently and will be hard to release and resecure after an initial use.

Accordingly, the apparatus of the present invention has been developed to provide a simple and expedient way to secure a keyway for the axially extending slot for the measurement-while-drilling or the surveying tool. The objectives of the invention are to provide a solid support for the key within the sub so that the orientation is always maintained. The installation and removal techniques for orienting the key are simple and reliable. Provisions are also made to resist release due to vibrational loads.

SUMMARY OF THE INVENTION

A mechanism for orienting and maintaining a key in a sub for guiding directional measurement equipment of a directional drilling assembly with respect to the drillbit is disclosed. The orienting sub has an outer sleeve which is supported on an inner shoulder in the orienting sub. An inner sleeve which holds the key has an outer wedged profile which follows the shape of the outer sleeve. The outer sleeve can be longitudinally, obliquely, or spirally segmented and has a thread on one end so that a jam nut can be installed to advance the inner sleeve with the key until a wedging action occurs between the inner and outer sleeves and the sub. At that point, the key is oriented without any bores through the wall of the sub. Provisions can be made in the assembly to provide a biasing force on the inner sleeve which holds the key to compensate for vibrational loads on the assembly.

DETAILED DESCRIPTION OF THE PREFERRED EMBODIMENT

Figure 1:
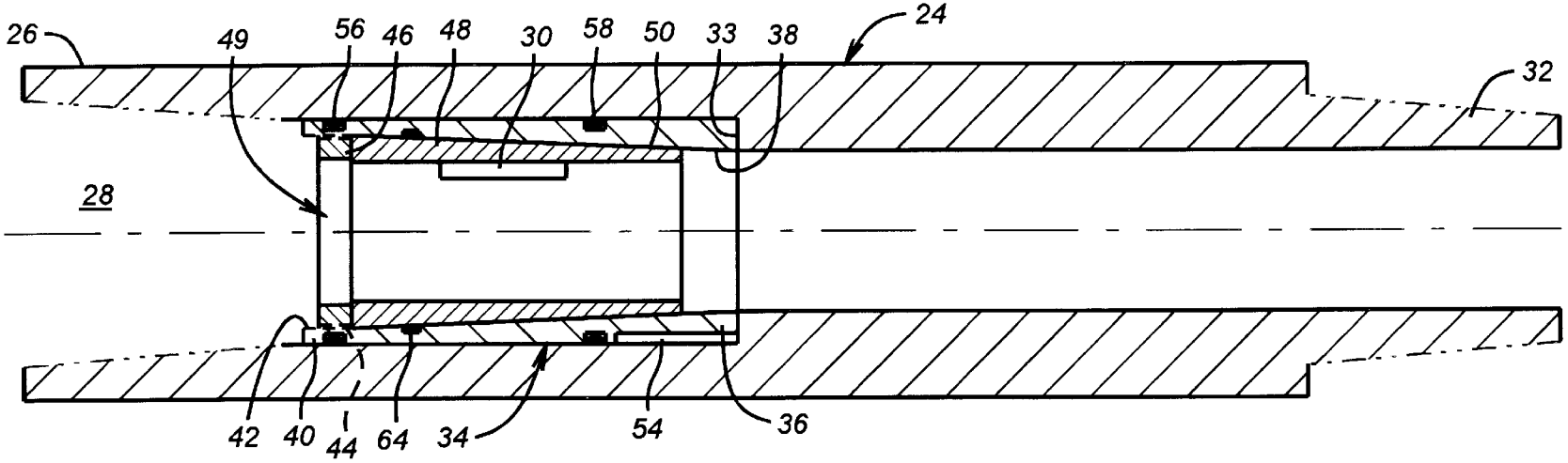
FIG. 1 is a sectional assembly of the apparatus installed in an orientation sub.

The orientation sub 24 has an upper end 26 through which the measurement equipment is inserted into passage 28. The muleshoe (not shown) of the measurement equipment has a longitudinal slot which ultimately orients itself with the key 30. The lower end 32 of the orientation sub 24 supports the downhole motor and the drillbit (not shown). Located in the downhole assembly and also not shown is the bent sub, which can be a separate assembly or integral with the housing of the downhole motor.

The orientation sub 24 has an internal shoulder 33. An outer sleeve 34 has a lower end 36 which engages the shoulder 33. The outer sleeve 34 has an internal taper 38 and an upper end 40. The extension of taper 38 transitions into a straight section 42, which has a thread 44 to accept a nut 46. Nut 46 has an internal bore 49 to allow passage of a tool T. While one version of such a tool T is shown in FIG. 3*a* for the inverted embodiment, the tool T for the embodiment shown in FIG. 1 is oppositely configured and shown in FIG. 5. However, the purpose of tool T is to hold the key 30 in a fixed position while the nut 46 is rotated and torqued up to an inner sleeve 48. Accordingly, the tool T for the configuration of FIG. 1 has an inner tube which braces the key 30 with an overlaying outer tube which can turn the nut 46 while the inner tube holds key 30. This tool T in FIG. 5, which is used in the FIG. 1 orientation, is the reverse of the tool T shown in FIG. 3*a*.

The inner sleeve 48 supports the key 30 and has an outer taper 50 that matches internal taper 38 on outer sleeve 34. The inner sleeve 48 also has a straight section 52 which is oriented adjacent straight section 42 of the outer sleeve 34. The angle of the tapers 38 and 50 can be a few degrees or more. The important thing is that when the nut 46 is rotated, sufficient wedging action occurs between tapers 38 and 50 to secure the position of key 30 against rotation and circumferential torque.

Figure 1B:
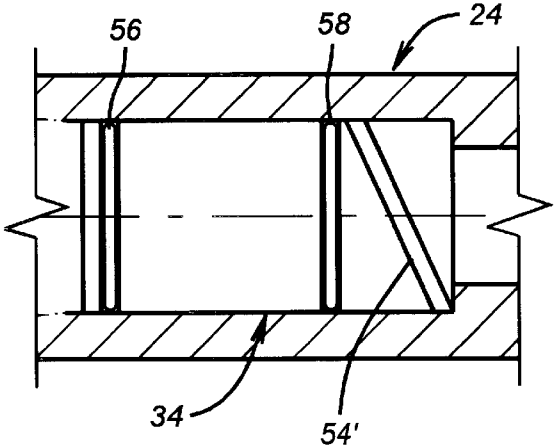
FIG. 1B is a section view showing a spiral split.
Figure 1A:
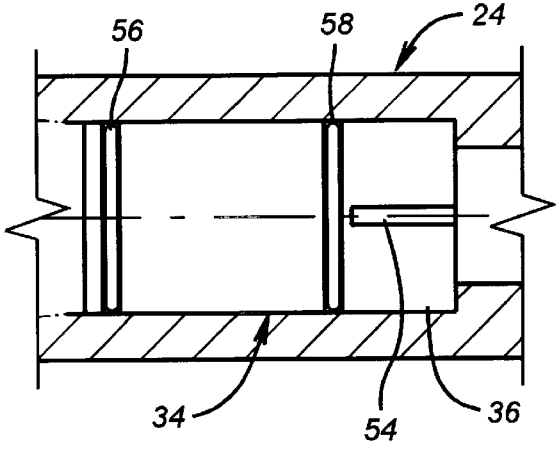
FIG. 1A is a section view showing a longitudinal split.

To facilitate wedging action of the outer sleeve 34, outer sleeve 34 has partial longitudinal 54 or otherwise oriented 54 split or splits that begin at lower end 36 and extend up to the straight section 42. The longitudinal split is shown in FIG. 1A as 54. The split as shown in FIG. 1B can also be placed spirally in the outer sleeve 34. Regardless of the configuration, the split 54 allows the outer sleeve to radially expand against orientation sub 24 at surface 25 as nut 46 drives the inner or key sleeve 48 axially with respect to outer sleeve 34.

While the preferred embodiment is shown in FIG. 1, it is within the scope of the invention to eliminate the outer sleeve 34. In this version, the inside surface of orientation sub 24 can be tapered and the outside surface 50 will be a matching taper. The split 54 would now be a part of key sleeve 48. The thread 44 can be integral with the orientation sub 24 so that the nut 46 is engaged directly to the orientation sub 24. when the nut is secured with the tool T, the key is prevented from rotation by slot 78, although it can still advance longitudinally as nut 46 is turned toward it. The slit 54 allows for radial expansion of the tapered surface, in this case 25, so that it wedges against what is in this embodiment a tapered surface 50.

Seal 56 can be used to seal between the orientation sub 24 and outer sleeve 34. Thus, the fluid flow from the surface going to the mud motor below essentially flows through passage 28 through inner sleeve 48 without circulating around the outside of the outer sleeve 34. Optionally, additional seals 58 and 64 can be employed between the orientation sub 24, the outer sleeve 34, and the inner sleeve 48 without departing from the spirit of the invention. If the mating parts of the design are correctly manufactured, seals are not required at all.

Figure 2:
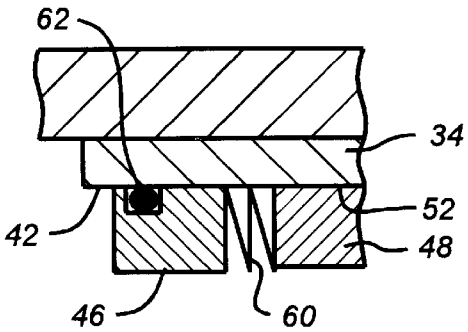
FIG. 2 is a detail of one end of the apparatus shown in FIG. 1.

Referring to FIG. 2, the outer sleeve 34 can have a straight section 42 of sufficient length to accept not only a nut 46 but also a spring 60 bearing on nut 46 and the top end of inner sleeve 48. In FIG. 2, the nut 46 is also shown with an internal seal 62. As previously stated, the inner sleeve 48 can have seals between itself and outer sleeve 34. The feature illustrated in FIG. 2 allows a bias force against the inner sleeve 48 to compensate for vibrational effects during drilling so as to keep the sleeve 48 properly wedged against the outer sleeve 34 by virtue of the bias force of spring 60 and the adjustment of nut 46. The presence of the spring also helps nut 46 from becoming undone due to vibrational loads.

Those skilled in the art will appreciate by a review of the description of the embodiment shown in FIGS. 1 and 2 that the orientation key 30 can be put into an orientation sub 24 and easily secured in a known orientation without any penetrations into the orientation sub 24. This design thus overcomes the drawbacks of the prior art designs that have penetrations through the orientation sub. When seals in those prior designs begin to leak and flow occurs through the set bolts or screws that are inserted in prior art designs, the result has been a washout of the set screws or bolts with a resulting loss of orientation in the bottomhole assembly as between the measurement equipment and the downhole motor with the bit. The illustrated technique is simple to make, simple to use, and does not suffer from the washout or loosening problems that can occur which have undermined prior methods of securing orientation keys. With the additions of seals such as 56 and 58 against orientation sub 24, and seal 64 between the sleeves, the fluid heading for the downhole motor is directed entirely through opening 49 in nut 46. The wedging action allows the key 30 to stay in place against significantly greater torque loads than the prior art set-screw-through-the-sub-wall design.

Figure 3:
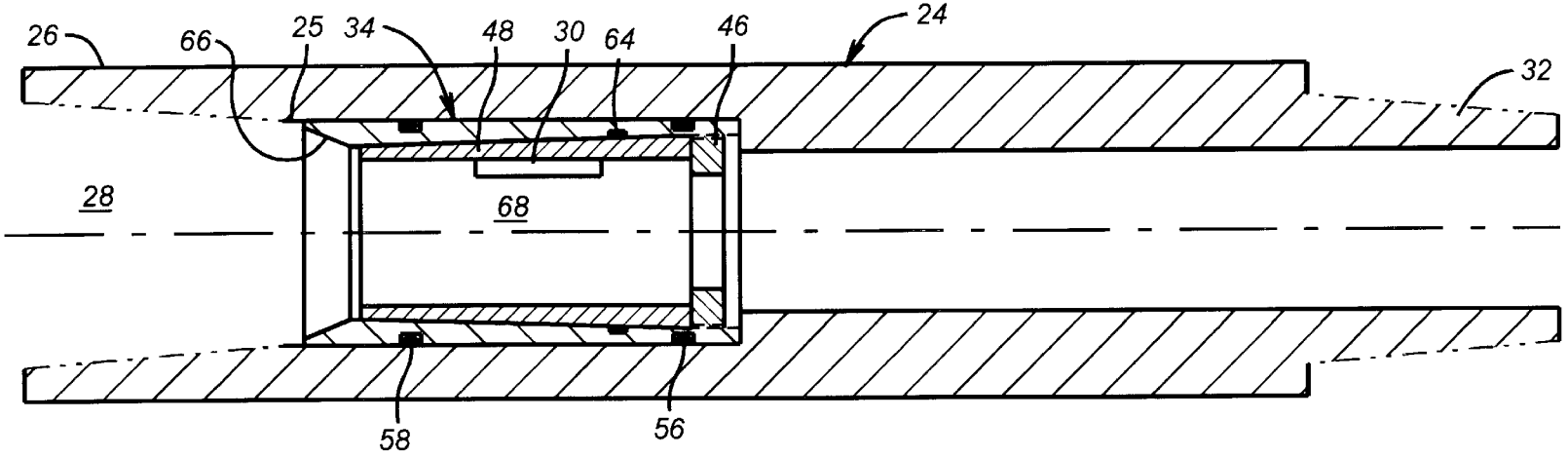
FIG. 3 is an inverted view of the apparatus installed in an orientation sub.
Figure 4:
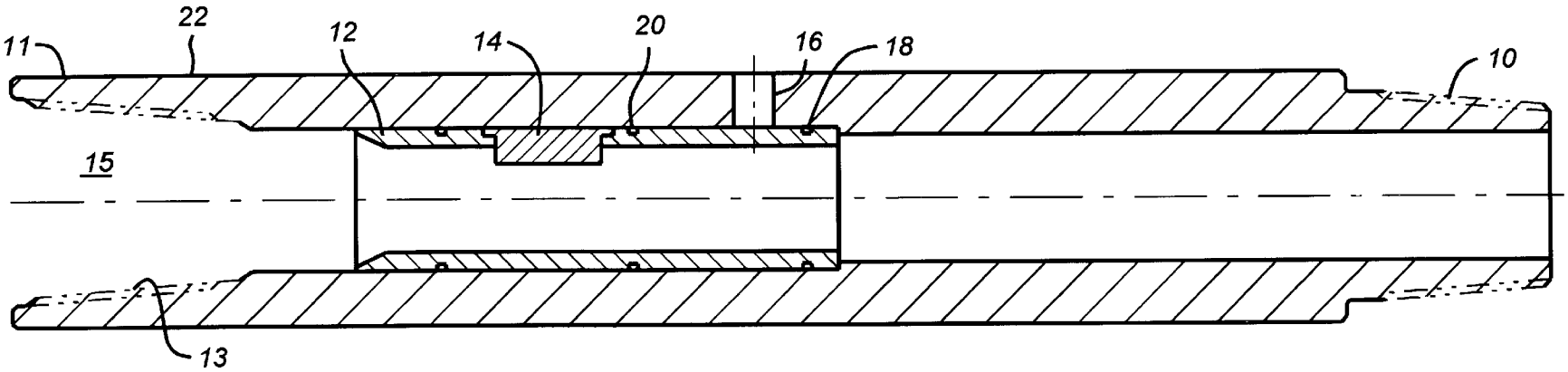
(PRIOR ART) FIG. 4
FIG. 4 is a prior art design.
Figure 3A:
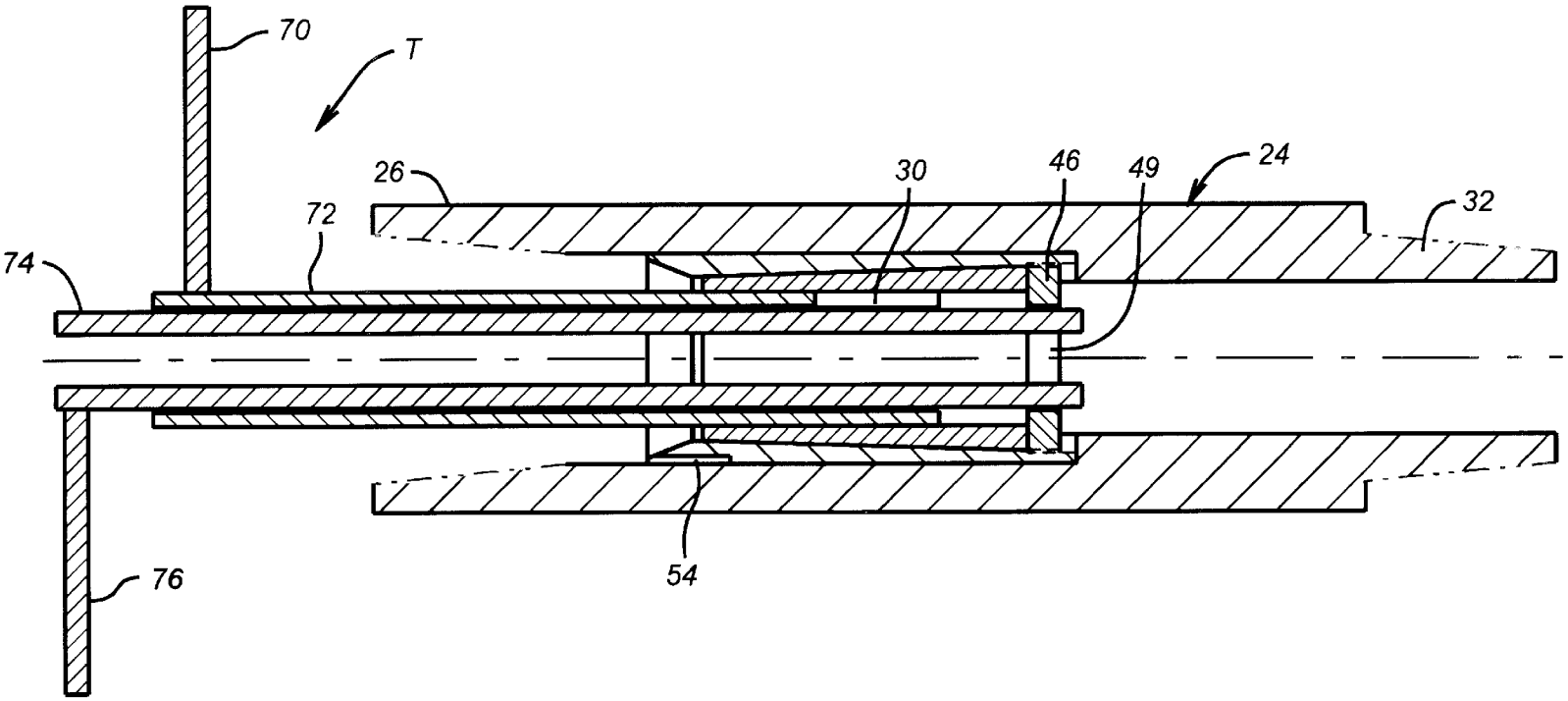
FIG. 3*a* is the view of FIG. 3, showing the installation tool that is used when the orientation shown in FIG. 3 is used.
Figure 3B:
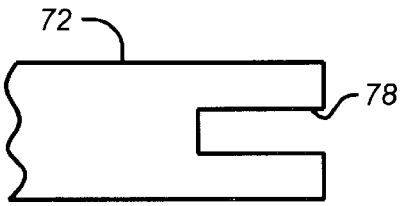
FIG. 3*b* is a detail of the low end of the tool T shown in FIG. 3*a*.
Figure 5:
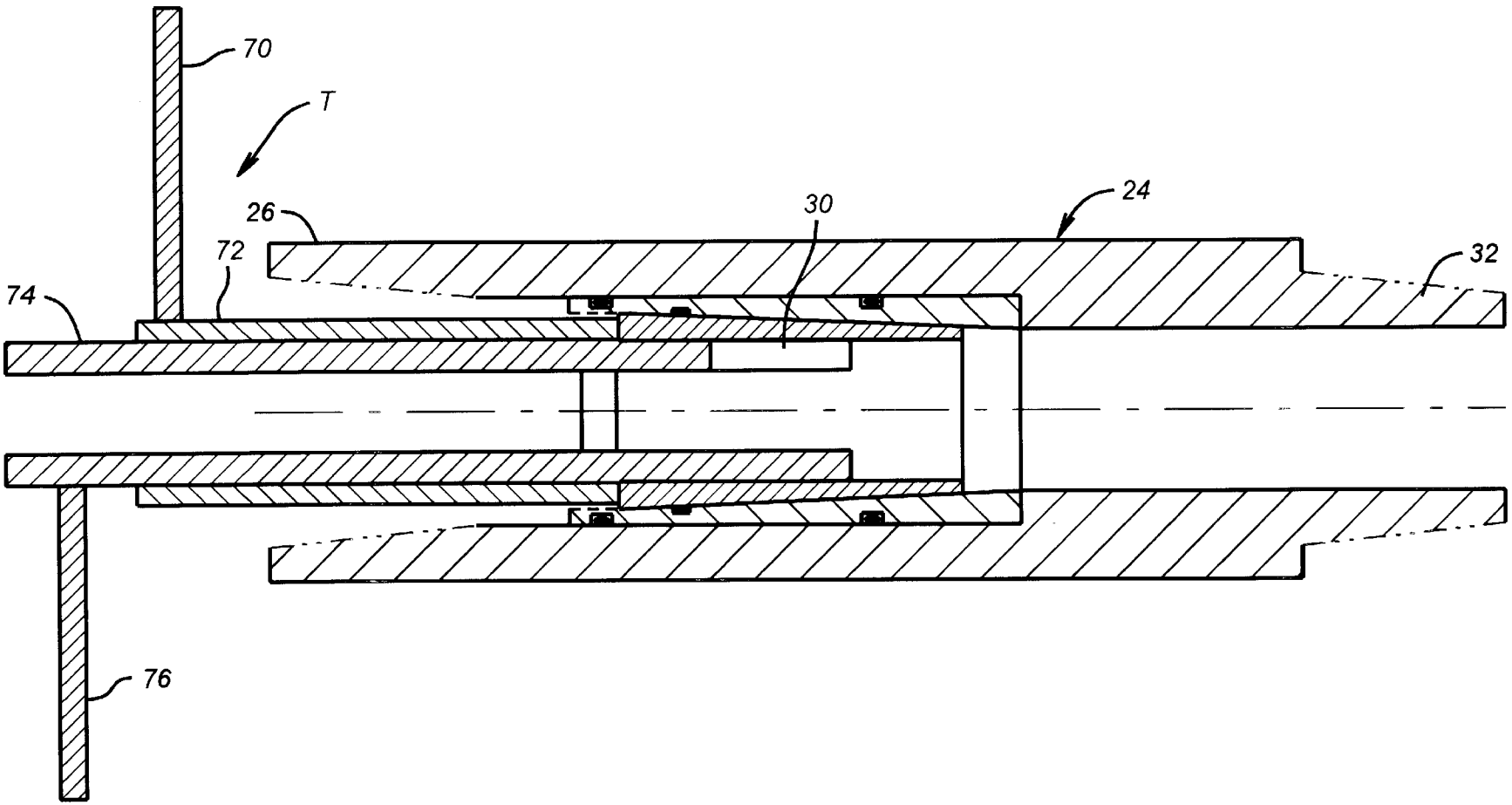
FIG. 5 is the view of FIG. 1, with the installation and removal tool T shown in position.

Referring now to FIG. 3, it can be seen that the same assembly can be inverted and inserted into the orientation sub 24. One of the differences is that the outer sleeve 34 has an inlet taper 66. The use of taper 66 deflects fluid arriving in passage 28 into the central bore 68 of the inner sleeve 48. FIG. 3*a* illustrates the tool T which has a handle 70 connected to a tube 72. Inside of tube 72 is tube 74, and handle 76 extends from tube 74. Tube 74 extends into opening 49 for rotation of the nut 46. Accordingly, opening 49 can be a hex and the lower end of tube 74 a matching hex to allow rotation of nut 46 for tightening or loosening. As the nut 46 is being tightened with tube 74 by counterclockwise rotation of handle 76, the handle 70 is held stationary. The lower end of tube 72 has a longitudinal slot 78 which straddles the key 30. The slot 78 and the handle 70 are aligned; therefore, the handle 70 always shows the exact position of the slot 78 and the key 30. The slot 78 on tube 72 is shown in more detail in FIG. 3*b*. In the embodiment of the tool T shown in FIG. 3*a*, tube 74 can rotate with respect to tube 72. The position of the key 30 is held steady by holding handle 70 stationary, as handle 76 is turned counterclockwise until a sufficient wedging force from nut 46 acts on inner sleeve 48 to wedge it into outer sleeve 34. The process is reversed for release. The longitudinal split 54 is also helpful in the removal or insertion of the sleeves 34 and 48 with nut 46. Once nut 46 is backed off sufficiently, the assembly will come right out or go right in. If it doesn't readily come out, it can be pushed out with a drift inserted through end 32. It should be noted that the tool T used in inserting the assembly as shown in FIG. 1 is very similar to the tool T shown in FIG. 3*a* except that the orientation of the tubes 72 and 74 is reversed. FIG. 5 illustrates the configuration of tool T for the orientation of the sleeves 34 and 48 as installed in FIG. 1.

The foregoing disclosure and description of the invention are illustrative and explanatory thereof, and various changes in the size, shape and materials, as well as in the details of the illustrated construction, may be made without departing from the spirit of the invention.

We claim:

1. An orientation key assembly for an orientation sub used in directional drilling and having an internal surface, comprising:

a key sleeve having a longitudinal axis and an orienting key extending therefrom;

a fastening assembly securable from within the orienting sub to secure said key sleeve to the internal surface of said orienting sub by a wedging action, said wedging action applying a force to said key sleeve substantially perpendicular to said longitudinal axis to secure it to the orientation sub.

2. The assembly of claim 1, wherein:

said fastening assembly further comprises a second sleeve, said second sleeve configured to be radially expandable;

said key and second sleeves having tapers such that relative axial movement between them results in a radial expansion of said second sleeve, resulting in a wedging of said key sleeve in the orienting sub.

3. The assembly of claim 2, wherein:

said second sleeve is mounted externally to said key sleeve such that said wedging action pushes said key sleeve against said second sleeve, which in turn expands against the orientating sub.

4. The assembly of claim 3, wherein:

said second sleeve comprises a threaded portion which accommodates a nut;

said nut when rotated advances against said key sleeve to force said tapers against the each other.

5. The assembly of claim 4, wherein:

said nut is formed having an opening therethrough;

said fastening assembly further comprises a tool that extends through said nut which can retain said key against rotation while turning said nut.

6. The assembly of claim 5, wherein:

said tool comprises first and second tubes, with said first tube having a slot to accept said key and a handle aligned with said slot to indicate its orientation, said second tube configured to engage said nut to turn it while said first tube is held stationary.

7. The assembly of claim 6, wherein:

said second sleeve has a longitudinal axis and is split to facilitate its radial expansion in the orienting sub.

8. The assembly of claim 7, wherein:

said split is substantially longitudinal.

9. The assembly of claim 7, wherein:

said split is in the form of a spiral.

10. The assembly of claim 7, further comprising:

a biasing member between said nut and said key sleeve.

11. The assembly of claim 10, wherein:

said second sleeve comprises a lower end which engages the orienting sub so as to limit further longitudinal movement thereof in one direction.

12. The assembly of claim 1, wherein:

said fastening assembly further comprises a nut and a tool capable of holding said key in a predetermined position, while at the same time advancing said nut to initiate said wedging action.

13. The assembly of claim 12, wherein:

said tool extends through said nut and is multi-component.

14. The assembly of claim 13, further comprising:

a second sleeve mounted between said key sleeve and the orienting sub, said sleeves having facing tapers which are forced against each other when said tool advances said nut.

15. The assembly of claim 14, wherein:

said tool comprises first and second concentric tubes, with said first tube having a slot to accept said key and a handle aligned with said slot to indicate its orientation, said second tube configured to engage said nut to turn it while said first tube is held stationary.

16. The assembly of claim 15, wherein:

said second sleeve is split to facilitate its radial expansion in the orienting sub.

17. The assembly of claim 16, further comprising:

a biasing member between said nut and said key sleeve.

18. The assembly of claim 17, wherein:

said second sleeve comprises a lower end which engages the orienting sub so as to limit further longitudinal movement thereof in one direction.

19. In combination, an orienting sub for directional drilling, having an internal surface, a longitudinal axis, and a key sleeve having a key thereon, wherein said key sleeve is secured to said internal surface of said orienting sub by a wedging action, said wedging action applying a force to said key sleeve substantially perpendicular to said longitudinal axis to secure it to the orientation sub.

20. The combination of claim 19, wherein:

said key sleeve has a taper and said orienting sub has a taper and a thread with a nut;

said key sleeve is split so as to allow it to contract into locking engagement with said orienting sub as said nut is advanced toward it.

21. The combination of claim 19, further comprising:

an outer sleeve having a taper thereon;

said key sleeve having a conforming taper to said taper on said outer sleeve;

said outer sleeve having a split and a threaded nut such that advancement of said nut forces said tapers together as said key sleeve moves axially with respect to said outer sleeve and, due to said split, said outer sleeve is further forced against said orienting sub.

22. The combination of claim 21, wherein:

said nut is formed having an opening to allow access therethrough to a tool, said tool holding said key while rotating said nut to force said tapers against each other.

* * * * *